US007090216B2

(12) United States Patent
Becker

(10) Patent No.: US 7,090,216 B2
(45) Date of Patent: Aug. 15, 2006

(54) DEVICE FOR STABILIZING SHEET GUIDANCE IN A SHEET-PROCESSING MACHINE

(75) Inventor: Willi Becker, Bammental (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 185 days.

(21) Appl. No.: 10/382,609

(22) Filed: Mar. 6, 2003

(65) Prior Publication Data

US 2003/0168799 A1 Sep. 11, 2003

(30) Foreign Application Priority Data

Mar. 6, 2002 (DE) ..... 102 09 707

(51) Int. Cl.
*B65H 5/02* (2006.01)

(52) U.S. Cl. ..... 271/277; 271/275

(58) Field of Classification Search ..... 271/275, 271/277

See application file for complete search history.

(56) References Cited

U.S. PATENT DOCUMENTS

| | | | |
|---|---|---|---|
| 4,697,512 | A | 10/1987 | Simeth |
| 5,390,600 | A | 2/1995 | Thünker |

FOREIGN PATENT DOCUMENTS

| | | | |
|---|---|---|---|
| DE | 1 916 198 | | 10/1970 |
| DE | 66 09 032 | | 1/1972 |
| DE | 34 45 886 | C2 | 6/1986 |
| DE | 37 10 756 | A1 | 1/1988 |
| DE | 84 16 548.0 | U1 | 12/1988 |
| DE | 43 15 844 | C2 | 1/1994 |
| EP | 1 057 626 | A1 | 12/2000 |

OTHER PUBLICATIONS

EP1057626, Michalak et al., Gripper Device for a Printing Press, Document Bibliography and Abstract.*

* cited by examiner

*Primary Examiner*—Eileen D. Lillis
*Assistant Examiner*—Kaitlin Joerger
(74) *Attorney, Agent, or Firm*—Luarence A. Greenberg; Werner H. Stemer; Ralph E. Locher

(57) ABSTRACT

A device for stabilizing sheet guidance in a sheet-processing machine includes a first transport device having first gripper devices for guiding sheets to be processed, and a second transport device having second gripper devices opposing the first gripper devices. The first gripper devices are in cooperation with the opposing second gripper devices, during an operation selected from the group of operations consisting of taking over and transferring the sheets. The opposing second gripper devices are dippable into interspaces formed between the first gripper devices, and at least one supporting element is disposed in the interspaces for supporting leading corners of the sheets, the supporting element being disposed locally fixed on the first transport device. The opposing second gripper devices are disposed in a region of the supporting element and include a forked gripper formed with a cutout into which the supporting element is dippable during transfer of a leading edge of the sheet.

13 Claims, 5 Drawing Sheets

DEVICE FOR STABILIZING SHEET GUIDANCE IN A SHEET-PROCESSING MACHINE

BACKGROUND OF THE INVENTION

Field of the Invention

The invention relates to a device for stabilizing sheet guidance in a sheet-processing machine, in particular, a sheet-fed rotary printing press.

In sheet-fed rotary printing presses, the paper sheets to be printed are taken off a sheet pile or stack and, with the aid of grippers disposed on rotating cylinders, are transported through individual printing units of the printing press, wherein they are printed with one, two or more colors in respective printing nips of the printing units. In this regard, the printing nips, respectively, are formed by setting blanket cylinders, which transfer the printing images for individual colors, against or in contact with respective impression cylinders.

During the transport of the sheets through the printing press, the sheets are held at respective leading edges thereof by gripper devices having a multiplicity of individual grippers, which are accommodated at a spaced distance from one another on a common gripper shaft. In this regard, each of the individual grippers cooperates with a gripper pad and is supported resiliently on the gripper shaft which, in order to open and close the grippers, is rotated forward and back at the cycle rate of the printing press by cam discs and cam rollers cooperating therewith.

In order to avoid a collision of the grippers during the transfer of the sheets between two adjacent cylinders in the printing press, the grippers of the first cylinder are led through interspaces formed between the opposing grippers of the cylinder that is arranged downstream.

For the purpose of transferring a sheet, the leading edge thereof is inserted by the closed grippers of the first cylinder into the opened opposing grippers of the second cylinder.

The opposing grippers of the second cylinder are then closed, and the grippers of the first cylinder are opened again, so that the sheet is briefly held by both gripper devices.

During the transport of the sheets, a problem arises that the two leading corners of a sheet tend to bend down or turn over, due to the great draft resulting from the travel of the sheet at high continuous printing speeds, if the corners should project beyond the respective gripper pad into the adjacent interspace between two grippers. The danger consequently arises that the leading edge of the sheet cannot be inserted reliably into the opened opposing grippers of the cylinder arranged downstream, whenever the corner of the sheet is bent or turned over, which leads not only to damage to the respective sheet but likewise frequently to a paper jam in the printing press.

From the published European Non-prosecuted Patent Application EP 1 057 626 A1, it has become known to arrange a movable sheet pad in the interspaces between two grippers, the pad being provided with a bevel and being moved out of the gripper plane by opposing grippers penetrating into the interspaces. Notwithstanding that the movable sheet pads are subject to high wear due to the mechanical actuation thereof by the opposing grippers, and tend to excite additional oscillations, they do not ensure the reliable insertion of the sheets also into the opened gripper devices of the succeeding cylinder, because the movable pads have already previously been lowered and no longer support the leading edge of the sheet.

Furthermore, from German Patent 34 45886, it has become known to arrange, between two grippers, additional grippers which, in a range of movement of an impression cylinder wherein the interspaces are released by the opposing grippers, are moved within the interspaces into the gripper plane, in order to increase thereat the holding forces on the leading edge of the sheet, as the sheet passes through the printing zone. The device described therein is very complicated mechanically and unsuitable for reliably protecting the corners of the sheets against turning or bending over as the corners enter the opened opposing grippers.

SUMMARY OF THE INVENTION

Accordingly, it is an object of the invention of the instant application to provide a device for stabilizing sheet guidance in a sheet-processing machine, in particular a sheet-fed rotary printing press, with which it is possible to prevent the leading corners of the sheets, in a mechanically simple manner and with high reliability, from turning or bending over during the transport of the sheets in the sheet-processing machine.

With the foregoing and other objects in view, there is provided, in accordance with the invention, a device for stabilizing sheet guidance in a sheet-processing machine, comprising a first transport device having first gripper devices for guiding sheets to be processed, a second transport device having second gripper devices opposing the first gripper devices, the first gripper devices being in cooperation with the opposing second gripper devices, during an operation selected from a group of operations consisting of taking over and transferring the sheets, the opposing second gripper devices being dippable into interspaces formed between the first gripper devices, and at least one supporting element disposed in said interspaces for supporting leading corners of the sheets, the supporting element being disposed locally fixed on the first transport device, the opposing second gripper devices being disposed in a region of the supporting element and comprising a forked gripper formed with a cutout into which the supporting element is dippable during transfer of a leading edge of the sheet.

In accordance with another feature of the invention, the supporting element has a suction-air opening located in a region of a leading corner of the sheets and being connectable to a suction-air source for applying suction to the sheets.

In accordance with a further feature of the invention, the cutout is formed exclusively in the forked gripper of the opposing second gripper device.

In accordance with an added feature of the invention, the supporting element is resiliently constructed so that, during trouble-free operation of the sheet-processing machine, the supporting element is held locally fixed on the first transport device by prestressing force and, upon a disruption in sheet travel, the supporting element is yieldable to forces caused by the disruption.

In accordance with an additional feature of the invention, the stabilizing device further comprises a supporting finger movable relative to the supporting element at a cycling rate of the sheet-processing machine, the supporting finger cooperating with the supporting element for disposing the leading corners of the sheets between the supporting finger and the supporting element.

In accordance with yet another feature of the invention, the supporting finger and the supporting element are spaced a distance from one another that is greater than a maximum processable sheet thickness.

In accordance with yet a further feature of the invention, the supporting finger is resilient, and is spaced from the supporting element a distance that is less than a minimum processable sheet thickness.

In accordance with yet an added feature of the invention, the first gripper devices have a gripper shaft, and the supporting finger is actuatable by the gripper shaft.

In accordance with yet an additional feature of the invention, the supporting finger is fixed directly to the gripper shaft.

In accordance with still another feature of the invention, the opposing second gripper device has a forked gripper pad formed with a further cutout into which, during sheet transfer, the supporting finger is dippable.

In accordance with still a further feature of the invention, the sheet-processing machine serves for processing a plurality of different sheet formats and, in each of the interspaces located between the first gripper devices and, lying in a region wherein leading edges for a minimum and a maximum sheet format are disposed, at least one of the supporting elements is provided for cooperating with an associated forked gripper of one of the opposing second gripper devices.

In accordance with still an added feature of the invention, first gripper devices comprise forked grippers formed with cutouts into which respective supporting elements disposed on the second transport device are dippable.

In accordance with a concomitant feature of the invention, the sheet-processing machine is a sheet-fed rotary printing press. Thus, according to the invention, there is provided a device for stabilizing sheet guidance in a sheet-fed rotary press, wherein sheets to be printed are guided in a conventional manner by first grippers and opposing second grippers arranged on transport devices of the printing press, comprising a supporting element disposed within a respective interspace formed between the first grippers, the opposing second grippers of one of the transport devices disposed upstream or downstream penetrating or dipping into the interspace, during transfer of the sheet leading edge. The transport devices are, for example, a first and second rotating cylinder or a drum and, respectively, a chain conveyor device or swinging gripper device belonging to the printing press. In the interest of simplification, however, the invention is described hereinbelow in terms of a first or second cylinder, for example.

The supporting element is preferably formed as a narrow web, for example, two to six mm wide, disposed locally fixed or immovable on an appertaining or associated cylinder or the drum of the printing press and which, on the radially outer side thereof, is formed with a supporting surface whereon the underside of the leading corner of a sheet rests when the latter is transported through the printing press.

The supporting element, in this regard, is of such length that the supporting surface of the supporting element is disposed at least approximately at the same height as the gripper pads of the appertaining or associated grippers of the cylinder, so that the leading edge of the sheets runs at least approximately in a straight line at one height, as the sheet is transported.

In order to avoid the possibility of a collision with the locally fixed supporting element during the transfer of the sheet leading edge by the opposing grippers, the opposing grippers are formed, in a manner according to the invention, as forked grippers which are provided with a preferably U-shaped or V-shaped cutout or recess into which the appertaining or associated supporting element can dip or penetrate during the transfer of the sheet leading edge.

The device according to the invention offers the advantage that the corners of the sheets always rest on the supporting surface of the supporting element as the sheets are transported after the sheet leading edge has been transferred by the opposing gripper devices, and cannot turn or bend over in a direction towards the center of the cylinder due to the draft caused by the travel thereof.

According to a further embodiment of the invention, the supporting element has a suction-air or vacuum opening located in the region of the leading edge or corner of the sheets, which opens into the supporting surface and is connectable to an externally arranged suction-air or vacuum source via an air feed line extending in the interior of the supporting element, and a conventional rotary valve. An advantage results therefrom in that the corners at risk of being turned or bent over are supported with respect to the interior of the cylinder by the supporting surfaces of the supporting elements, and the corners are also effectively prevented from turning or bending over towards the outside, because the underside of the respective corner is fixed on the supporting surface of the supporting element due to the suction action. In this regard, the construction of the opposing grippers as forked grippers ensures that the leading corners of the sheets, after being taken over by the opposing grippers, are drawn off the supporting surface of the supporting element without difficulty, i.e., without any risk of the corners being turned or bent over or of any other damage.

Furthermore, with regard to the required expenditure for construction, it is advantageous if, in the case of the embodiment of the supporting elements provided with suction-air or vacuum openings, the U-shaped or V-shaped cutout or recess is formed exclusively in the forked gripper, and the gripper pad associated therewith is formed without any cutout or recess, in like manner as the other gripper pads of the gripper bar.

In order to avoid serious damage to the supporting elements according to the invention in the event a double sheet or sheet crumpling occurs, the supporting elements are preferably accommodated on the cylinder by a resilient or spring element, for which purpose the supporting elements can be formed, for example, as rod-like elements which extend through a bore formed in the cylinder and running radially, as far as the level of the gripper pads of the cylinder, into the respective interspaces or recesses underneath the corners which are at risk of being turned or bent over. In this regard, the rod-like supporting elements can be supported via a compression spring and a stop plate that limits the free movement of the rod-like supporting element towards the outer side of the cylinder, in a manner that the rod-like supporting element remains in a stationary or locally fixed position thereof under prestressing force and is moved into the interior of the cylinder, counter to the prestressing force of the spring, only when the action of an external force caused by a disruption of the sheet travel is exceeded. In this way, damage to the supporting elements or grippers is effectively prevented.

According to a further embodiment of the invention, the supporting element cooperates with a supporting finger which is moved at the cyclic rate of the processing machine or printing press and is preferably moved in a radial direction towards the supporting element, parallel to the grippers of the cylinder. The supporting finger, in this regard, is formed in such a manner and preferably connected directly to the gripper shaft in such a way that the side of the supporting finger facing towards the supporting surface of the supporting element, when the grippers are closed, is disposed at a very slight distance just sufficiently large enough for the sheets to be held with little play between the supporting finger and the supporting element or, in the case of a supporting finger formed of resilient material, is clamped with slight pressure between the supporting finger and the supporting element, without any relevant additional sheet holding force being produced thereby.

The embodiment according to the invention offers the advantage that the supporting finger can be constructed very narrowly and produced from very lightweight material, for example from plastic material or a lightweight metal and, thereby, in contrast with conventional grippers, produces no markedly additional mass moments of inertia which, in particular at very high production printing speeds, make additional reinforcement of the entire gripper device necessary.

In this embodiment of the invention, the gripper pads of the opposing grippers are preferably also of forked construction, so that, as the sheet is transferred, the supporting finger can penetrate or dip into a further cutout or recess formed in the forked gripper pad.

If the sheet-fed rotary printing press allows the processing of sheet formats of different widths, as is generally the case currently, a plurality of supporting elements and forked grippers according to the invention, which are associated therewith, are preferably provided adjacent to one another, each thereof being arranged in the interspaces or recesses arranged in the region of the leading corners of the sheets for the respective sheet format. Expressed in other words, for each sheet format, a supporting element according to the invention is arranged in the interspace located underneath the two leading corners.

Other features which are considered as characteristic for the invention are set forth in the appended claims.

Although the invention is illustrated and described herein as embodied in a device for stabilizing sheet guidance in a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
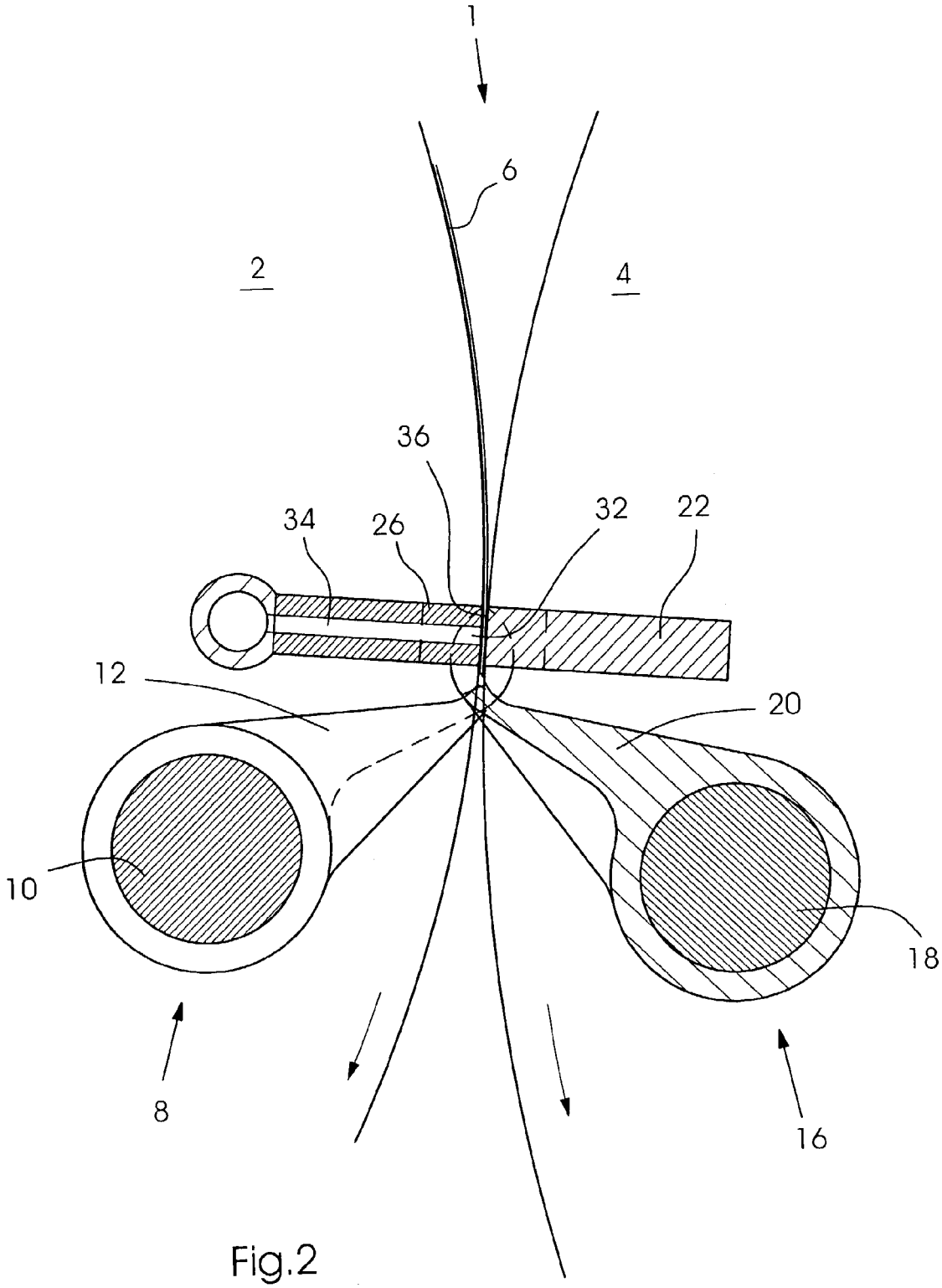
FIG. 2 is a fragmentary diagrammatic side elevational view, partly in section, of opposing gripper devices in a sheet-fed rotary printing press engaged in a transfer of the leading edge of a sheet from the one gripper device to an opposing gripper device, the leading corners of the sheet being supported by a supporting element according to the invention having a vacuum or suction-air opening.

As illustrated in FIG. 2, a sheet-fed rotary printing press 1 comprises a first cylinder 2 arranged upstream in a sheet travel direction, and a second cylinder 4 arranged downstream thereof, whereon sheets 6 to be printed are transported through the printing press 1. Arranged on the upstream cylinder 2 is a gripper device 8 including a gripper 12 that is actuated by a gripper shaft 10 and cooperates with a gripper pad 14 which, for example, is shown in detail in FIGS. 3 and 4.

Arranged in a similar manner on the downstream cylinder 4 is an opposing gripper device 16 including an opposing gripper 20 that is accommodated on an opposing gripper shaft 18 and cooperates with an opposing gripper pad 22 in a conventional manner.

Figure 3:
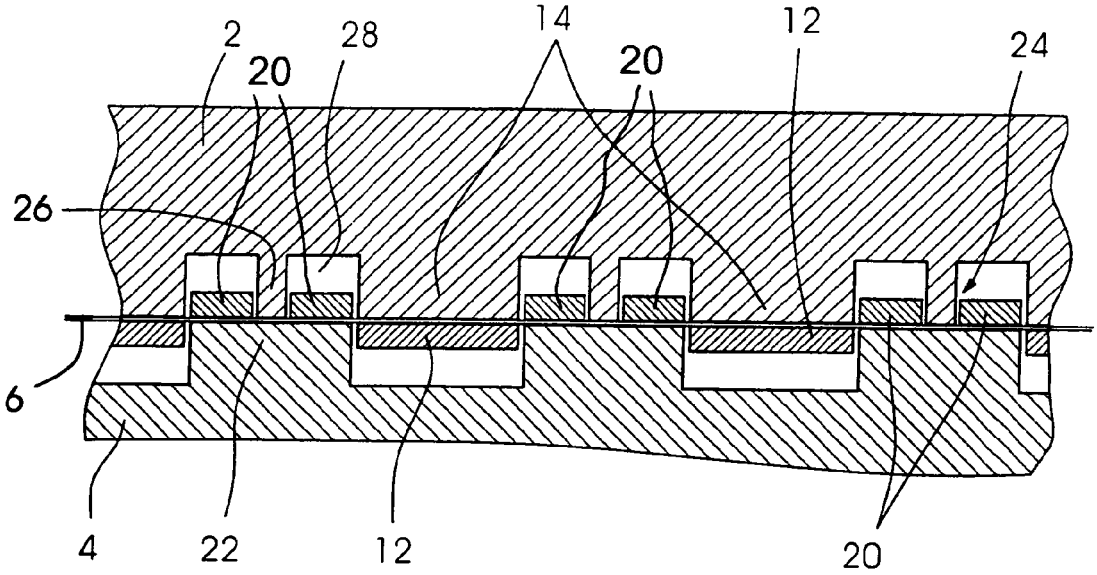
FIG. 3 is a diagrammatic sectional view of an embodiment of the invention wherein a plurality of supporting elements formed as supporting webs are arranged on one of the cylinders of the rotary printing press.
Figure 4:
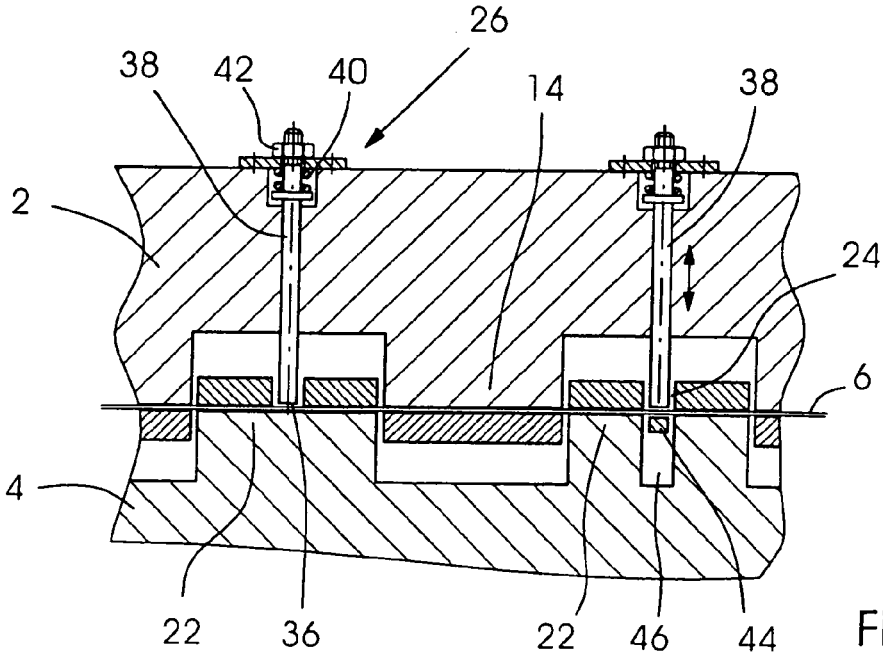
FIG. 4 is a slightly enlarged view of FIG. 3 showing a further embodiment of the invention, wherein the supporting elements are formed of spring-loaded supporting rods cooperating with forked opposing grippers.

As shown, for example, in FIGS. 3 and 4, the gripper 20 of the opposing gripper device 16 is forked and is formed with a preferably U-shaped or V-shaped cutout or recess 24 into which a supporting element 26 according to the invention penetrates or dips, as the leading edge of a sheet 6 is transferred from the gripper device 8 to the opposing gripper device 16, the supporting element 26 being disposed in an interspace 28 formed in the cylinder 2 underneath one of the two leading corners 30 (note FIG. 1) of the sheet 6, in order to support the appertaining corner 30 during the transport of the sheet 6. In the embodiment of the invention shown in FIG. 3, the supporting element 26 preferably has the shape of a web.

Figure 1:
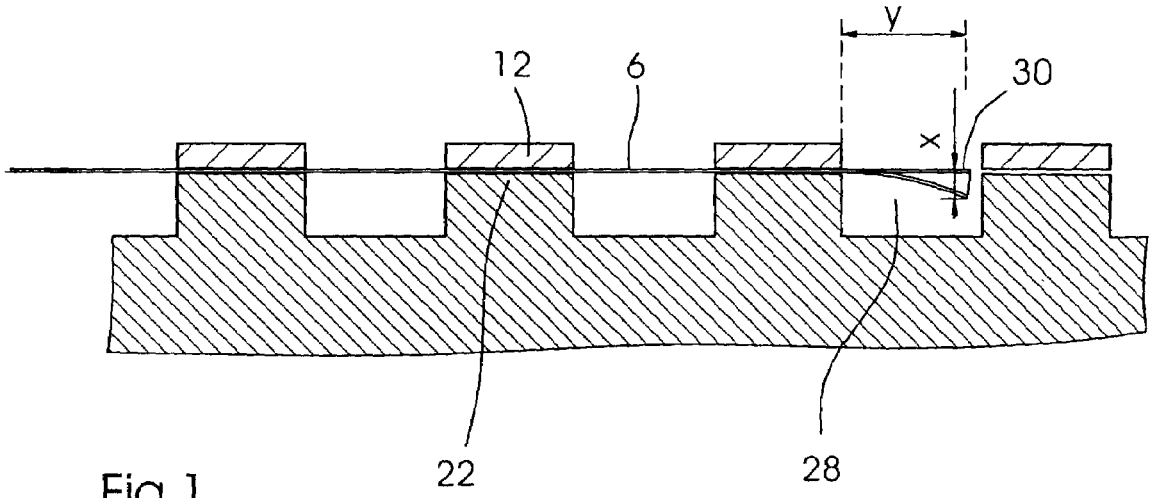
Fig.1 Prior Art
FIG. 1 is a diagrammatic sectional view of a gripper device in a sheet-fed rotary printing press according to the prior art, wherein the leading corners are not held by supporting elements arranged in the interspaces between the grippers and, as a result, tend to be turned or bent over because of the draft caused by traveling during the transport.
Figure 7:
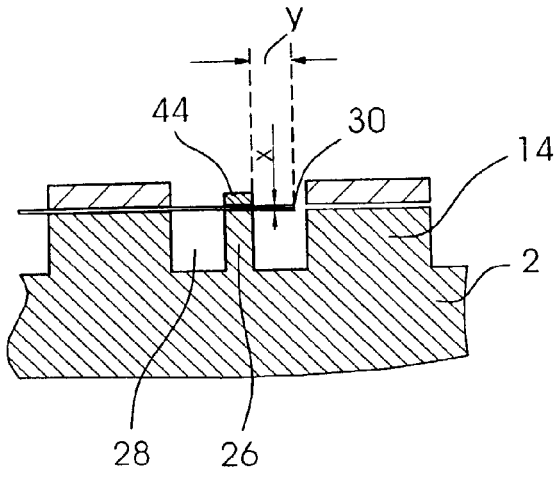
FIG. 7 is an enlarged fragmentary view of FIG. 6, with one of the cylinders, namely the cylinder 4, omitted, and the other cylinder 2 in reversed position, showing a leading sheet corner held between a respective supporting element and an associated supporting finger, for the purpose of illustrating the supportive effect of the supporting element according to the invention.

The supporting function of the supporting elements 26 according to the invention is illustrated by way of example in FIG. 7, while FIG. 1 shows a deflection X of the corner 30 in the case of a sheet-fed rotary printing press wherein no supporting element 26 according to the invention is used.

As is believed to be apparent from a comparison of FIG. 1 and FIG. 7, during the transport of the sheets 6 on the cylinders 2 and 4 outside the transfer region, as a result of the action of the supporting element 26 according to the invention, the sheet corner 30 is deflected in FIG. 7 to a considerably lesser extent into the interspace 28 than is the case in the prior art according to FIG. 1. Due to the cubic or third-power dependence of the deflection X of the corners 30 on the free length Y of the projecting region of the sheet corner 3, should the free length Y of the projecting region be halved, the deflection X of the corner is reduced by a factor of eight. Accordingly, a risk of a turnover or bending of the leading sheet corners 30 is reduced to a very great extent.

Figure 9:
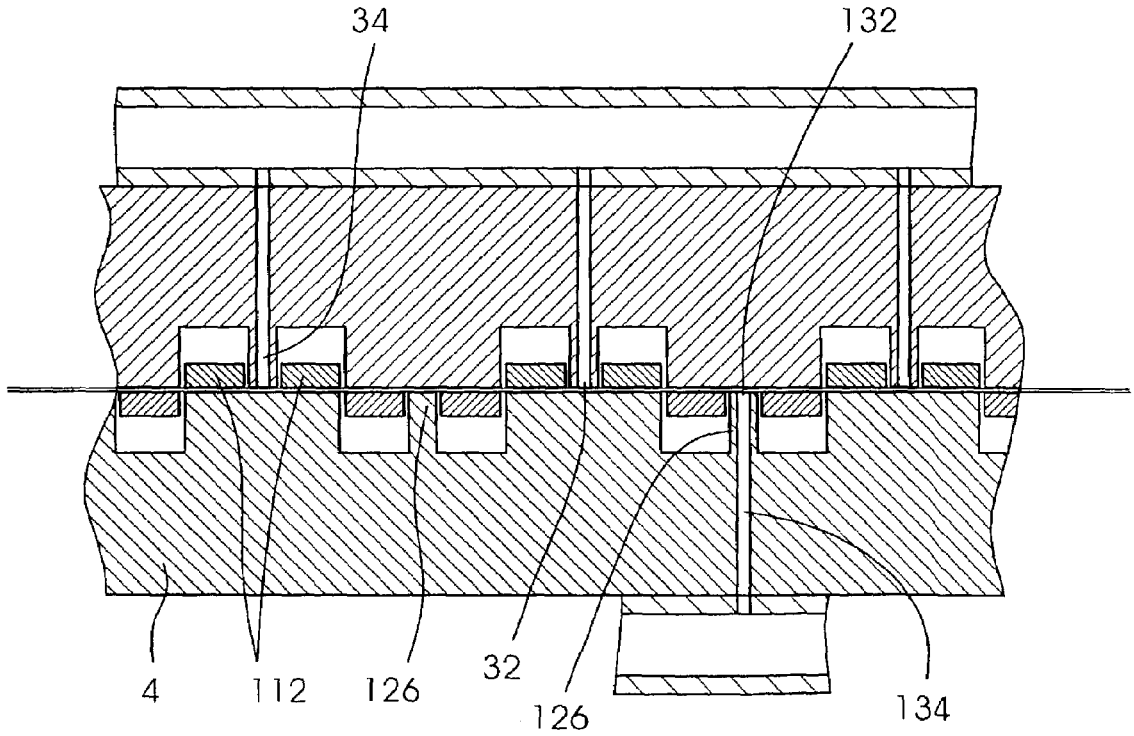
FIG. 9 is another view similar to that of FIG. 8 of a further embodiment of the invention, wherein supporting elements provided with vacuum or suction-air openings are provided both on the upstream sheet-guiding cylinder and on the downstream sheet-guiding cylinder, a forked gripper and an opposing gripper, respectively, being assigned to the respective supporting elements.

According to FIGS. 2 and 9, in a preferred embodiment of the invention, the supporting element 26 is formed with a vacuum opening 32 which, via a vacuum bore 34, 134 formed in the interior of the supporting element 26, 126, and otherwise not specifically illustrated feed lines and a non-illustrated rotary valve, is connected to a likewise non-illustrated vacuum or suction-air source, preferably at the cycling rate of the printing press. During the transport of the sheets 6, due to the suction action, the leading sheet corners 30 are thereby sucked against the associated supporting surfaces 36 of the supporting elements 26 and, even at very high production-run printing speeds, are reliably fixed on the supporting elements 26 against being turned or bent over outwardly due to the occurring centrifugal force.

According-to a further embodiment of the invention illustrated in FIG. 4, the supporting elements 26 comprise supporting rods 38 which are radially movable within a bore formed in the cylinder 2 and, via resilient devices in the form of compression springs 40 supported on the cylinder 2, are urged in a direction towards the outside of the cylinder 2, i.e., towards the underside of the sheet 6. As may further be ascertained from FIG. 4, the supporting rods 38, at the respective ends thereof directed away from the sheet 6, are formed with a threaded section with a nut 42 screwed thereon via which the position of the supporting surface 36 of the rods 38 with respect to the sheet 6 can be varied. In the event of a fault in the sheet run, for example, a paper jam or a double sheet, the supporting rods 38 yield or give way in a direction towards the center of the cylinder 2, counter to the prestressing force acting thereon due to the compression spring 40, thereby avoiding damage to the supporting rods 38.

According to a further embodiment of the invention shown in FIGS. 4, 5, 6 and 7, a supporting finger 44 is disposed directly on the gripper shaft 10 of the gripper device 8, and is moved by the gripper shaft 10 at the cycling rate of the printing press relative to the supporting element 26 firmly connected to the cylinder 2. In this regard, the supporting finger 44 cooperates with the supporting element 26 in a manner that the leading sheet corners 30 (FIG. 7) are positioned between the supporting finger 44 and the supporting element 26 during the transport of the sheets 6.

In this regard, the supporting finger 44 can be formed, for example, of a hard, intrinsically stiff material, such as steel. Moreover, between the supporting finger 44 and the supporting element 26, there remains a spacing which is preferably greater than the maximum sheet thickness processable by the printing press 1.

Figure 5:
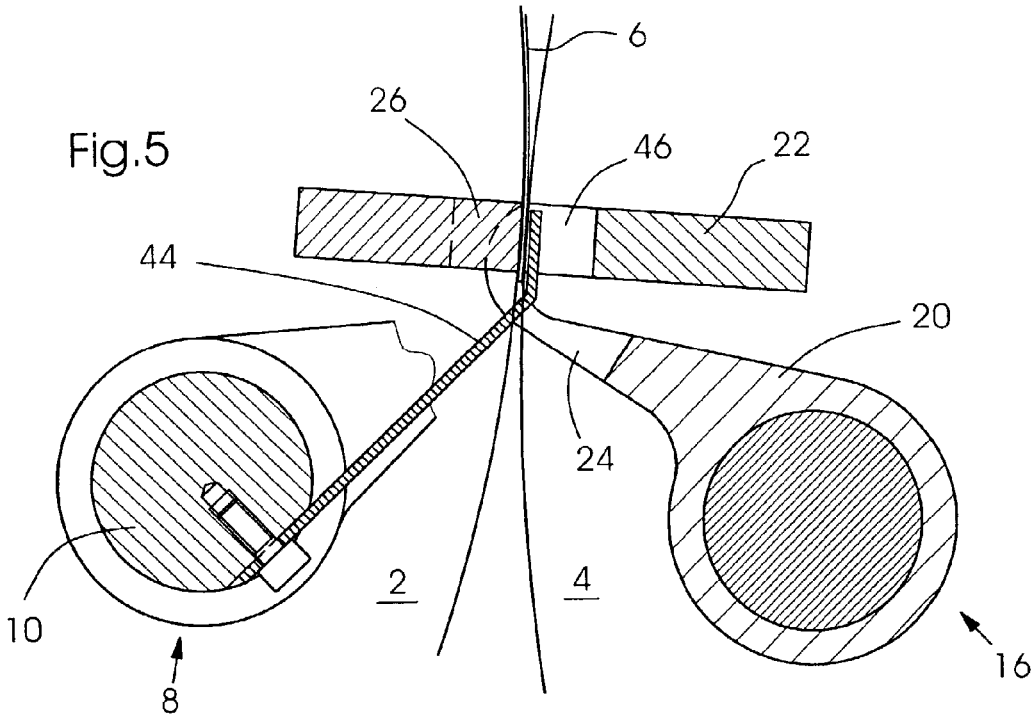
FIG. 5 is another view like that of FIG. 2 showing a further embodiment of the invention, wherein the supporting elements are formed as supporting webs which cooperate with a supporting finger moving at the cyclic rate of the printing press.
Figure 6:
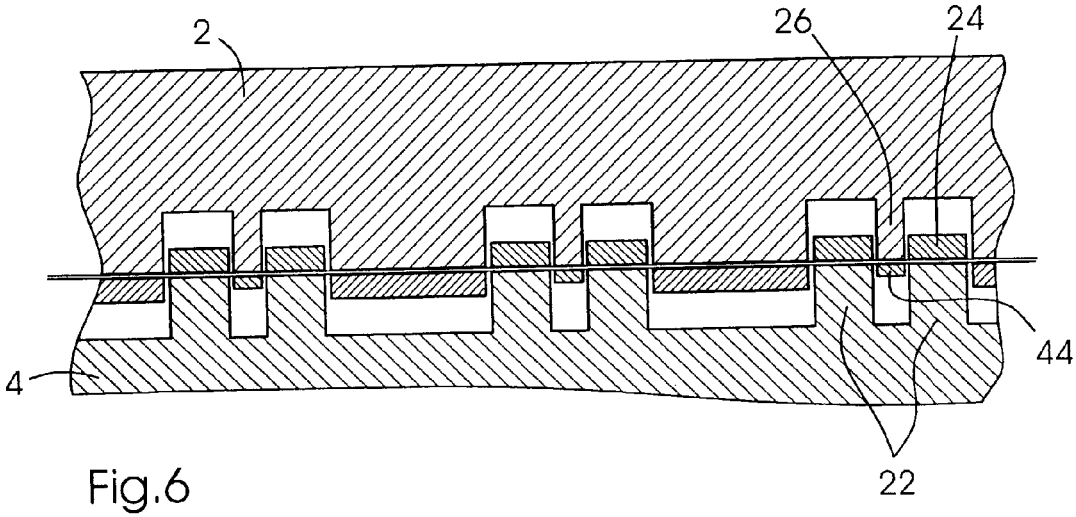
FIG. 6 is a view like that of FIG. 3 of the further embodiment of FIG. 5, wherein a plurality of supporting elements and associated supporting fingers are provided on a cylinder.

According to a further embodiment of the invention, provision can also be made, however, for the supporting finger 44, as shown in FIG. 5, to be formed of a thin, resilient material, for example, of spring steel, and to be positioned in a manner that the spaced distance between the supporting finger 44 and the supporting element 26, when the supporting finger 44 is in contact, is less than the minimum sheet thickness that can be processed, so that, depending upon the thickness of the sheet material processed, a more-or-less intense clamping action acts upon the leading corners 30 of the sheets. The magnitude of this clamping action, however, is not comparable with the clamping action that is exerted by the powerful and highly precise gripper devices 8 and opposing gripper devices 16 for producing the high tensile and holding forces on the sheet 6, which are sufficient for the sheet transport.

In order to prevent a collision between the supporting finger 44 and the gripper pads 22 of the opposing gripper device 16, in the described embodiment which uses a supporting finger 44, in addition to the cutout or recess 24 formed in the forked gripper 20, a further cutout or recess 46 is formed in the gripper pad 22 of the opposing gripper device 16, so that the supporting finger 44 penetrates or dips into the further cutout or recess 46 during the sheet transfer.

Figure 8:
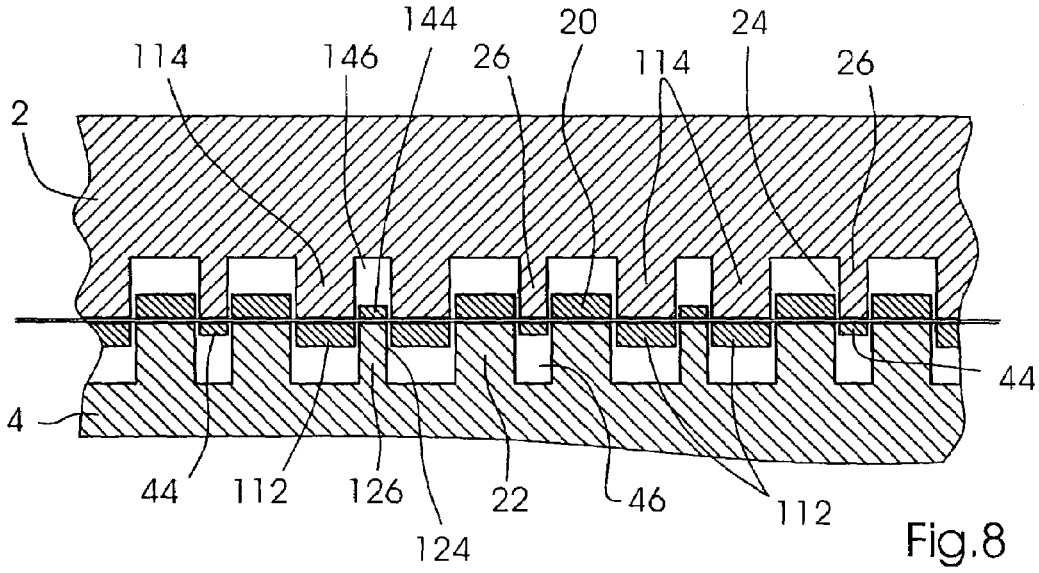
FIG. 8 is another view like that of FIG. 6 showing a further embodiment of the invention, wherein the supporting elements and associated supporting fingers are arranged both on an upstream and on a downstream cylinder in the sheet-fed rotary printing press.

As shown in FIG. 8, provision can further be made for not only the grippers 20 and/or the gripper pads 22 of the opposing gripper devices 16 to be fork-shaped or forked with cutouts or recesses 124, 146 formed therein, but also the gripper devices 8 of the cylinder 2 to be configured as forked grippers, which cooperate with correspondingly formed supporting elements 126 on the cylinder 4 arranged downstream, so that the supporting elements 126 on the cylinder 4 arranged downstream can penetrate or dip into the cutouts 124 formed between the forked grippers 112.

In this regard, provision can be made in the same way for the supporting elements 126 to cooperate with supporting fingers 144 which are mounted on the downstream-disposed cylinder 4, and that penetrate or dip into correspondingly formed further cutouts or recesses 146 which are formed in the forked gripper pads 114 of the cylinder 2 that is disposed upstream. An advantage thereby results, in that, irrespective of the sheet format, the leading corners 30 are reliably prevented from being turned or bent over both during the takeover of the sheets 6 by the upstream cylinder 2 and during the transfer of the sheets 6 from the upstream cylinder 2 to the downstream cylinder 4.

According to FIG. 9, provision can be made in a corresponding manner for providing the supporting elements 126 on the downstream-disposed cylinder 4 with vacuum or suction-air openings 132, which have vacuum or suction air applied thereto via corresponding vacuum or suction-air bores 134.

Furthermore, the possibility arises, if desired, for simultaneously using both supporting elements 126 having vacuum or suction-air openings 132 and supporting elements 126 formed only as simple webs.

I claim:

1. A device for stabilizing sheet guidance in a sheet-processing machine, comprising:

a first transport device having first gripper devices for guiding sheets to be processed;

a second transport device having second gripper devices opposing said first gripper devices;

said first gripper devices being in cooperation with said opposing second gripper devices, during an operation selected from a group of operations consisting of taking over and transferring the sheets, said opposing second gripper devices being dippable into interspaces formed between said first gripper devices; and at least one supporting element disposed in said interspaces for supporting leading corners of the sheets, said supporting element being disposed locally fixed on said first transport device, said opposing second gripper devices being disposed in a region of said supporting element and including a forked gripper divided on the end into two sections by a cutout formed therein into which said supporting element is dippable during transfer of a leading edge of the sheet, said forked gripper of said second gripper devices entirely cooperating with only one gripper pad.

2. The stabilizing device according to claim 1, wherein said supporting element has a suction-air opening located in a region of a leading corner of the sheets and connectable to a suction-air source for applying suction to the sheets.

3. The stabilizing device according to claim 1, wherein said supporting element is resiliently, constructed so that, during trouble-free operation of the sheet-processing machine, said supporting element is held locally fixed on said first transport device by prestressing force, and upon a disruption in sheet travel, said supporting element is yieldable to forces caused by the disruption.

4. The stabilizing device according to claim 1, further comprising a supporting finger movable relative to said supporting element at a cycling rate of the sheet-processing machine, said supporting finger cooperating with said supporting element for disposing the leading corners of the sheets between said supporting finger and said supporting element.

5. The stabilizing device according to claim 4, wherein said supporting finger and said supporting element are spaced a distance from one another that is greater than a maximum processable sheet thickness.

6. The stabilizing device according to claim 4, wherein said first gripper devices have a gripper shaft, and said supporting finger is actuatable by said gripper shaft.

7. The stabilizing device according to claim 6, wherein said supporting finger is fixed directly to said gripper shaft.

8. The stabilizing device according to claim 4, wherein said opposing second gripper device has a forked gripper pad formed with a further cutout into which, during sheet transfer, said supporting finger is dippable.

9. The device for stabilizing sheet guidance in a sheet-processing machine according to claim 1, wherein the sheet-processing machine serves for processing a plurality of different sheet formats, and wherein, in each of the interspaces located between said first gripper devices and lying in a region wherein leading edges for a minimum and a maximum sheet format are disposed, at least one of said supporting elements is provided for cooperating with an associated forked gripper of one of said opposing second gripper devices.

10. The stabilizing device according to claim 1, wherein said first gripper devices comprise forked grippers formed with cutouts into which respective supporting elements disposed on said second transport device are dippable.

11. The stabilizing device according to claim 1, wherein the sheet-processing machine is a sheet-fed rotary printing press.

12. The stabilizing device according to claim 1, wherein said cutout is formed exclusively in said forked gripper of said opposing gripper device.

13. A device for stabilizing sheet guidance in a sheet-processing machine, comprising:

a first transport device having first gripper devices for guiding sheets to be processed;

a second transport device having second gripper devices opposing said first gripper devices;

said first gripper devices being in cooperation with said opposing second gripper devices, during an operation selected from a group of operations consisting of taking over and transferring the sheets, said opposing second gripper devices being dippable into interspaces formed between said first gripper devices;

at least one supporting element disposed in said interspaces for supporting leading corners of the sheets, said supporting element being disposed locally fixed on said first transport device, said opposing second gripper devices being disposed in a region of said supporting element and including a forked gripper divided on the end into two sections by a cutout formed therein into which said supporting element is dippable during transfer of a leading edge of the sheet; and a supporting finger movable relative to said supporting element at a cycling rate of the sheet-processing machine, said supporting finger cooperating with said supporting element for disposing the leading corners of the sheets between said supporting finger and said supporting element, and said supporting finger being resilient, and being spaced from said supporting element a distance that is less than a minimum processable sheet thickness.

* * * * *